United States Patent [19]

Whitaker

[11] 4,217,704

[45] Aug. 19, 1980

[54] FOOTWEAR

[76] Inventor: Mervin A. Whitaker, P.O. Box 3702, Eugene, Oreg. 97403

[21] Appl. No.: 920,454

[22] Filed: Jun. 29, 1978

[51] Int. Cl.[2] ..... A43B 3/16

[52] U.S. Cl. ..... 36/7.1 R; 36/59 R

[58] Field of Search ..... 36/59 R, 59 C, 59 D, 36/25 R, 7.1, 7.3, 7.6, 7.7, 102

[56] References Cited

U.S. PATENT DOCUMENTS

| | | | |
|---|---|---|---|
| 1,195,866 | 8/1916 | Stephan | 36/7.7 X |
| 1,716,790 | 1/1929 | Mitchell | 36/59 R |
| 3,075,307 | 1/1963 | Becker | 36/7.7 |
| 3,699,672 | 10/1972 | Sims | 36/7.7 |

*Primary Examiner*—Patrick D. Lawson

*Attorney, Agent, or Firm*—James D. Givnan, Jr.

[57] ABSTRACT

Footwear for wearing over shoes or boots and having a sole of non-woven synthetic fibres providing a high degree of traction with a slippery surface. A shell is of flexible material and protects the shoe or boot from contact with harsh chemicals used in floor cleaning compounds. The shell may include reduced areas to facilitate attachment and removal of the present footwear.

3 Claims, 5 Drawing Figures

FOOTWEAR

BACKGROUND OF THE INVENTION

The present invention is concerned with footwear of the type worn over shoes and boots.

In the maintaining of floors of commercial establishments it is common practice to utilize powered floor cleaning and polishing equipment. Such equipment is oftimes awkward to handle which problem is accentuated by the presence of liquid floor stripping compounds, cleaners or wax on the floor surface. The controlling of such equipment by an operator standing on such a slippery floor surface constitutes a risk to the worker. Further, the traversing of slippery floors about a work site with or without the operation of powered equipment, can be considered risky as falls and serious injuries have resulted from such floor surfaces.

The treating of large floor areas of commercial establishments normally entails the use of strong chemical compounds for the purpose of entirely removing or stripping old wax and dirt from the floor surface. Such chemical compositions have a degradatory effect on the life of work shoes worn by maintenance people to the extent that shoe life is severely reduced. The wearing of rubber boots is inconvenient and further such tend to leave floor marks.

SUMMARY OF THE PRESENT INVENTION

The present invention is embodied within protective footwear of an elastomeric nature and having a fibrous sole of substantial depth to provide a footwear article conveniently used over conventional shoes or boots by those encountering slippery surfaces.

A shell of the present footwear is of elastic nature readily conformable to a range of shoe sizes and configurations to permit the user to readily apply and remove same from conventional footwear. The shell may substantially fully enclose an oxford type shoe or, alternatively, protect only the forward portion of the shoe and sole in instances where the shoe or boot heel is of a material not subject to depreciation by a floor cleaning compound. A still further version of the present invention includes a rubber shell having both enclosed front and heel portions each provided with a fibrous pad with a reduced portion of the shell located approximately at the shoe instep.

The present foot wear utilizes a flexible pad of synthetic fibrous material of substantial thickness secured to the underside of the footwear shell which pad accomplishes the following desirable results. As these pads may be of the same material presently used in the manufacture of floor maintenance pads as used on power driven machines, the same provide a very high coefficient of friction with a floor or other surface while having desirable characteristics of being both flexible and long wearing. Further, the pad material is available from several sources and manufactured in thicknesses ranging up to one inch or so contributing to present sole durability. A still further benefit realized by use of such pad material is that of enabling the cleaning of floor areas and corner areas inaccessible to large diameter power driven pads. The wearer may clean such small areas by foot action. Similarly, particularly difficult areas to clean are rapidly cleaned by wearer foot action.

Important objectives of the present invention include protective footwear utilizing a flexible shell adaptable to a range of various shoe sizes and shapes; the provision of footwear utilizing readily available, low cost fibrous sole material hertofore commonly used in the manufacture of power driven floor maintenance pads; the provision of footwear having an enclosed forward portion in combination with a fibrous pad such being retained on the shoe of the wearer by a heel engaging band; the provision of protective footwear having an elastomeric shell of a resilient nature provided with sole and heel components of synthetic fibrous material with fitting of the shell to the shoe enhanced by a reduced side portion of the shell; the provision of footwear which both protects the wearer's shoes from damaging floor cleaning compounds as well as having a sole having a high coefficient of friction with a supporting surface to minimize the risk of slipping.

DETAILED DESCRIPTION OF THE PREFERRED EMBODIMENT

Figure 1:
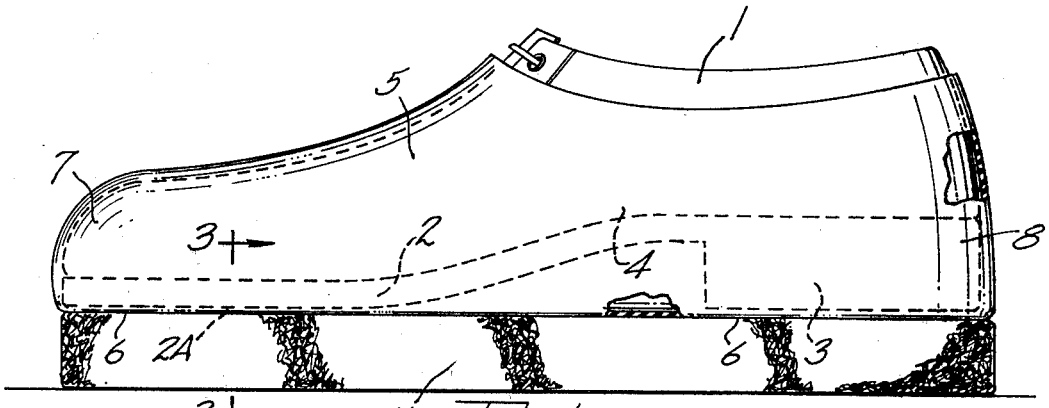
FIG. 1 is a side elevational view of a piece of footwear made in accordance with the present invention.
Figure 2:
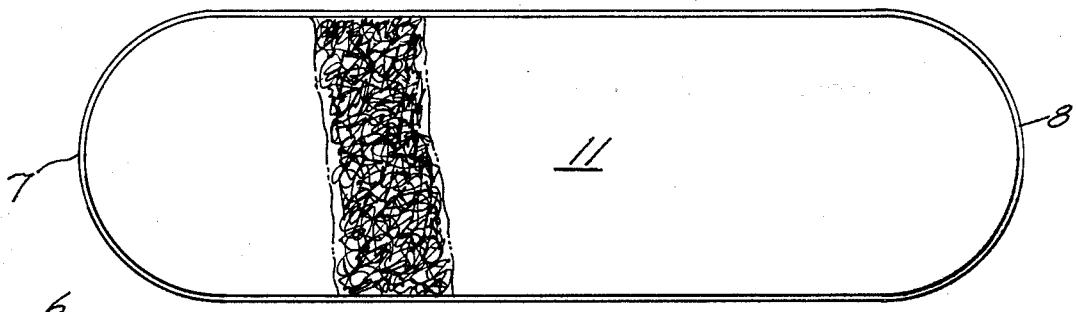
FIG. 2 is a bottom plan view thereof.
Figure 3:
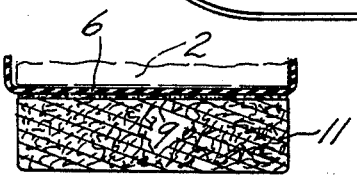
FIG. 3 is a vertical sectional view taken along line 3—3 of FIG. 1.

With attention to FIG. 1 of the drawing, the reference numeral 1 indicates the upper of a conventional oxford type shoe also having a sole 2 and a heel 3. An instep portion of the shoe is indicated at 4. A sole tread is indicated at 2A.

The present footwear includes a shell 5 of rubber or other elastomeric material capable of receiving a range of shoe sizes. Shell 5 includes a planar bottom wall 6 per FIG. 1 extending from a shell toe portion 7 to a shell heel portion 8. Opening 10 in the shell permits application of same to the shoe.

A pad is indicated at 11 of uniform height from front to rear and comprised of non-woven synthetic fibrous material such as that manufactured and sold as floor maintenance pads for use on power driven floor maintenance equipment. Commonly, such pads range in thickness from ½ inch to 1 inch with variations in fibre characteristics and density providing differing degrees of abrasiveness for cleaning or polishing. Pads suitable for present use may include those manufactured from interlocked polyester or nylon fibres to provide a highly abrasive, long wearing pad 11. Such pad material, generally termed floor maintenance pads, are manufactured by several firms well known to those in the maintenance industry. One such suitable floor maintenance pad is manufactured and sold under the registered trademark FIBERBOND.

For purposes of economical utilization of the pad material the same may be cut in straight sided shapes or, alternatively, may be in the plan configuration of a conventional sole and heel shape.

Securement of pad 11 to the bottom wall 6 of the shell may be by any means such as a suitable adhesive or bonding agent 9 not susceptible to those chemicals commonly used in floor cleaning compounds.

Figure 4:
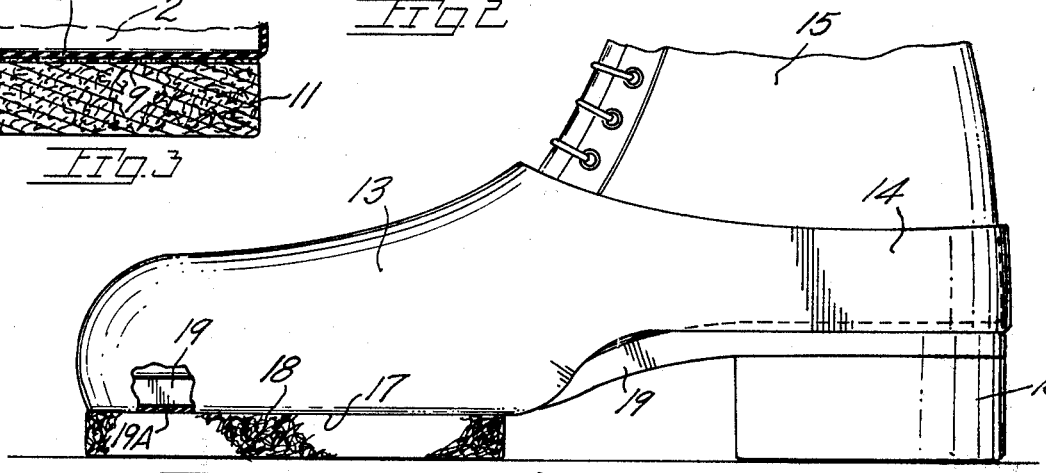
FIGS. 4 and 5 are views similar to FIG. 1 but showing modified forms of the invention.

With attention to FIG. 4, modified footwear includes a vamp shell 13 having a stretchable heel band 14 stretchingly engageable with the rearward portion of a shoe or boot upper 15 of the type having a heel 16 of synthetic material not susceptible to damage by floor cleaning compounds. A vamp or forward portion of the present modification includes a bottom wall 17 to which is suitably secured a fibrous pad 18 which may be of somewhat lesser height than the first noted sole portion 11. Bottom wall 17 underlies a shoe or boot sole 19 having a tread 19A and terminates at the instep of the of the underlying shoe with the remainder of shell 13 being in the form of a stretchable heel band 14.

Figure 5:
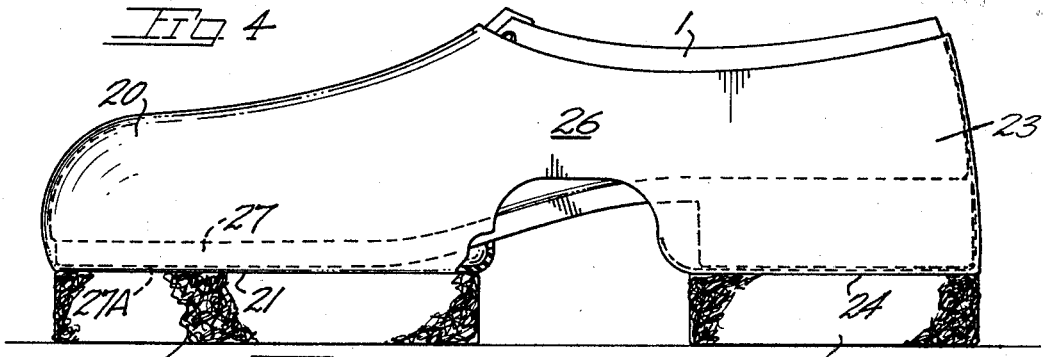

With attention now to FIG. 5, the same discloses a still further modification having a forward shell 20 with a bottom wall 21, underlying a sole tread 27A of a sole 27, and to which is secured a sole pad 22 in the above described manner. Similarly, a heel portion at 23 of the modified footwear encloses the heel of a shoe and includes a bottom wall 24, underlying the heel surface, to which is applied a pad 25. A reduced side element 26 of the shell facilitates stretching of same to ease application and removal of the shell from a shoe or boot.

In use, the shoe protecting shell is applied over the footwear being worn with the shell having a degree of resiliency. The fibrous pad provides sure footing on all types of slippery surfaces and may flex to permit normal flexing of the shoe or boot. In addition to providing the desired traction on slippery floors the present footwear may be used to exert concentrated scrubbing action by foot motion on a floor area such as in a corner or where chewing gum or the like has stuck to the floor.

It will be apparent that the present footwear may have uses other than those elaborated.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

1. Protective non-slip footwear for wearing over conventional footwear to protect the sole, heel and upper of same from damaging chemical floor treating compounds, said non-slip footwear comprising, a flexible shell for retentive engagement with the conventional footwear, said shell including toe and heel portions for substantially enclosing the conventional footwear upper and also including a continuous planar bottom wall extending the length of the shell subjacent the sole and heel of the conventional footwear, and a pad attached to said planar bottom wall of said shell and coterminous therewith, said pad being of synthetic fibres and having upper and lower pad surfaces lying in spaced apart planes with the lower pad surface being of randomly orientated synthetic fibres to provide a high degree of traction for the protective footwear.

2. The protective non-slip footwear claimed in claim 1 wherein said shell is of elastomeric material for stretched encasing engagement with the upper of said conventional footwear.

3. The protective non-slip footwear claimed in claim 2 wherein said pad is of uniform depth and substantially co-extensive in length with the shell bottom wall.

* * * * *